US006857932B2

(12) United States Patent
Chen

(10) Patent No.: US 6,857,932 B2
(45) Date of Patent: Feb. 22, 2005

(54) BREAST FORM ENCASED WITH FABRIC LAMINATED THERMOPLASTIC FILM

(75) Inventor: David E. Chen, Walnut, CA (US)

(73) Assignee: Bragel International, Inc., Pomona, CA (US)

( * ) Notice: Subject to any disclaimer, the term of this patent is extended or adjusted under 35 U.S.C. 154(b) by 0 days.

(21) Appl. No.: 10/075,476

(22) Filed: Feb. 14, 2002

(65) Prior Publication Data

US 2003/0153244 A1 Aug. 14, 2003

(51) Int. Cl.[7] ..... A41C 3/00
(52) U.S. Cl. ..... 450/38; 2/267
(58) Field of Search ..... 450/32, 38, 39, 450/55–57, 81; 623/7, 8; 2/267

(56) References Cited

U.S. PATENT DOCUMENTS 4,019,209 A * 4/1977 Spence ..... 450/57
5,071,433 A * 12/1991 Naestoft et al. ..... 623/7
5,693,164 A 12/1997 Chang
5,733,335 A * 3/1998 Ishikawa et al. ..... 623/7
6,042,608 A * 3/2000 Ishikawa et al. ..... 623/7
6,231,423 B1 * 5/2001 Deal et al. ..... 450/57

* cited by examiner

*Primary Examiner*—Gloria M. Hale
(74) *Attorney, Agent, or Firm*—Christie, Parker & Hale, LLP

(57) ABSTRACT

An improved breast form, constructed according to the principles of this invention, comprises a flexible chamber formed from a pair of polyurethane sheets that are sealed together along a perimeter edge of the chamber. A volume of silicone gel composition is sealably disposed within the flexible chamber. A fabric material is disposed over and permanently joined to a surface portion of each of the polyurethane sheets. The fabric material forms an exterior surface of the breast form, and is made from a four-way stretchable fabric.

20 Claims, 2 Drawing Sheets

BREAST FORM ENCASED WITH FABRIC LAMINATED THERMOPLASTIC FILM

FIELD OF THE INVENTION

The present invention relates to an improved breast form, particularly a breast form having a volume of silicone gel material encased by fabric laminated thermoplastic film.

BACKGROUND OF THE INVENTION

Women who, for whatever reason, are not satisfied with the size of their own breasts and desire larger, more shapely breasts must select among two alternative methods for enhancing their breast size, by either using rudimentary externally worn articles, such as foam pads and the like, or by undergoing a surgical operation to be fitted with a breast implant. Opting for use of a surgical breast implant carries with it the danger inherent in any surgical operation and can be quite expensive. In addition to the dangers inherent with the surgical operation is the potential health dangers that may be associated with using a particular type of breast implant, namely, the silicone breast implant. Accordingly, women wishing to enhance their physical appearance in a non-permanent and health-risk free manner opt to use one of the many types of externally worn articles.

A key feature of such externally worn article is that it look and feel natural so as to complement and not detract from the existing female breast that it is used to enhance. In addition to enhancing an existing breast, externally worn articles are designed to replace a female human breast that has been surgically removed. Externally worn articles that can be worn for the purpose of either enhancing or replacing human breasts are referred to a breast forms, and include a wide range of breast enhancers, breast inserts, and breast prostheses. A popular type of breast form has been made from a silicone gel material that is completely encased by plastic film material. The advantage of this type of breast form is that it looks like a natural human breast when worn and feels natural to the user, thus enhancing the self image and confidence of the user. Other breast forms, such as foam pads, water-filled pads and the like, do not afford the user these important qualities but, rather, look unnatural and feel foreign.

For many users, the available silicone gel breast forms do not match the skin color of the user. Attempting to cover the breast form with a fabric or material that more closely resembles the user's skin, however, is not desirable because the plastic material encasing the silicone gel will move independently of the fabric cover, thereby causing the breast form to move from its desired position and the fabric cover to bunch-up or wrinkle. Therefore, there exists a need for a breast form that can be made available in a wide range of colors, yet still have the same adjustability and customization as the breast forms that are encased by plastic film.

An additional limitation of known silicone gel breast forms has been the ability to make the breast forms lighter in weight, yet still maintain a desirable appearance. For example, it is common to experience severe discoloration in the breast form if silicone gel material is replaced with a lighter, "filler" material. Because merely covering the breast forms with a fabric or material has not been desirable, there remains a need for a breast form that can be made from a lightweight material, yet still maintain a desirable appearance and function.

SUMMARY OF THE INVENTION

The present invention provides an improved breast form that comprises a volume of silicone gel material encased between fabric laminated thermoplastic film. The fabric laminated thermoplastic film can be in one or two sheets, where each sheet has two layers, namely a fabric layer and a thermoplastic layer. The fabric layer is made from any suitable four-way stretchable material, such as the elastic spandex fabric sold under the trade name LYCRA, and the thermoplastic layer is made from any suitable polymeric material, such as polyurethane. The fabric layer and the thermoplastic layer are permanently and inseparably adjoined by heat lamination or a similar process.

Because the fabric layers are formed from a four-way stretchable material, the fabric layer and the thermoplastic layer are able to move together in all directions, thereby allowing for full adjustment of the breast form by the user and preventing wrinkling of the fabric layer. Further, the fabric layer can be made in any color, which allows users to select a breast form that best matches their skin pigment, or perhaps a color that matches their bra or clothing.

An additional feature of the present invention is that the present breast form can be made from lightweight silicone gel materials without concern of being visually pleasing to the wearer. Such lightweight silicone gel materials make use of certain fillers that provide a visual look that may not be appealing. However, because the silicone gel material is encased by one or more sheets of fabric laminated thermoplastic film, i.e., a nontransparent material, the color of the encased material is not important.

An additional feature available for the present breast form is that it can includes a permanently grown, re-usable pressure-sensitive adhesive (PSA) backing on an interior surface of the breast form, i.e., a surface of the breast form placed against a user's body, which prevents the breast form from moving from its desired position on the user.

DETAILED DESCRIPTION

Figure 1:
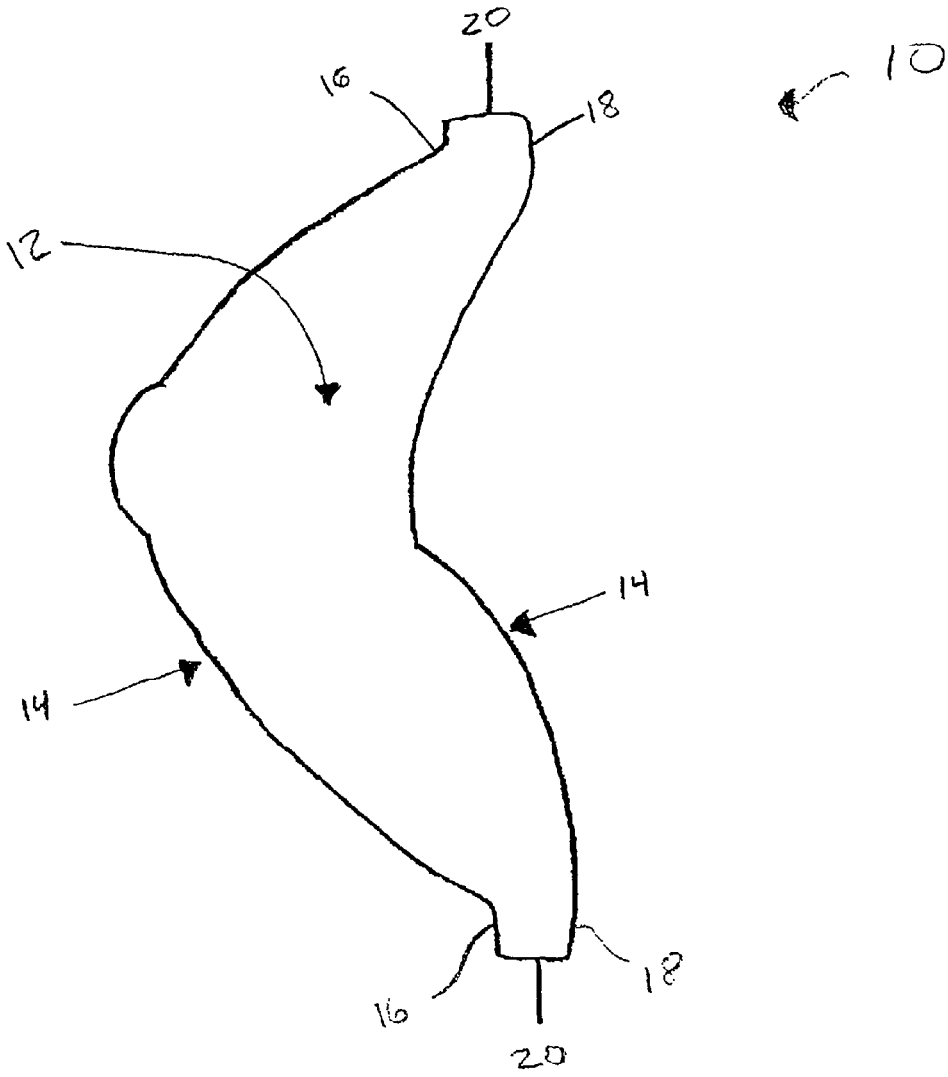
FIG. 1 is a side view of abreast form constructed according to principles of this invention.

Breast forms, constructed according to the principles of this invention, generally comprise a silicone material that is encased by a fabric laminated thermoplastic film material. FIG. 1 illustrates a side view of a breast form embodiment 10 of this invention. The breast form 10 is intended to serve as a full-range of externally worn articles that can be worn to enhance or replace a user's breasts. Accordingly, the breast form 10 can be configured as and/or used in the capacity of breast inserts, breast enhancers, and breast prostheses.

The breast form 10 generally includes a volume of silicone gel material 12 disposed within a flexible chamber formed from a thermoplastic film material having permanently joined and disposed to it a fabric material. Preferably the silicone gel material 12 is encased by a fabric laminated thermoplastic film 14, which preferably comprises two sheets 16 and 18, which are positioned on opposite sides of the silicone gel material 12 and adjoin along points 20, which define a perimeter seal or edge of the breast form. It is to be understood, however, that it is not necessary to have the fabric laminated thermoplastic film 14 made from the two sheets 16 and 18. Rather, as discussed below, the breast form 10 can be made from a single sheet of the fabric laminated thermoplastic material 14. Therefore, the properties discussed with respect to the two sheets 16 and 18 are equally applicable to the fabric laminated thermoplastic film 14.

Figure 2:
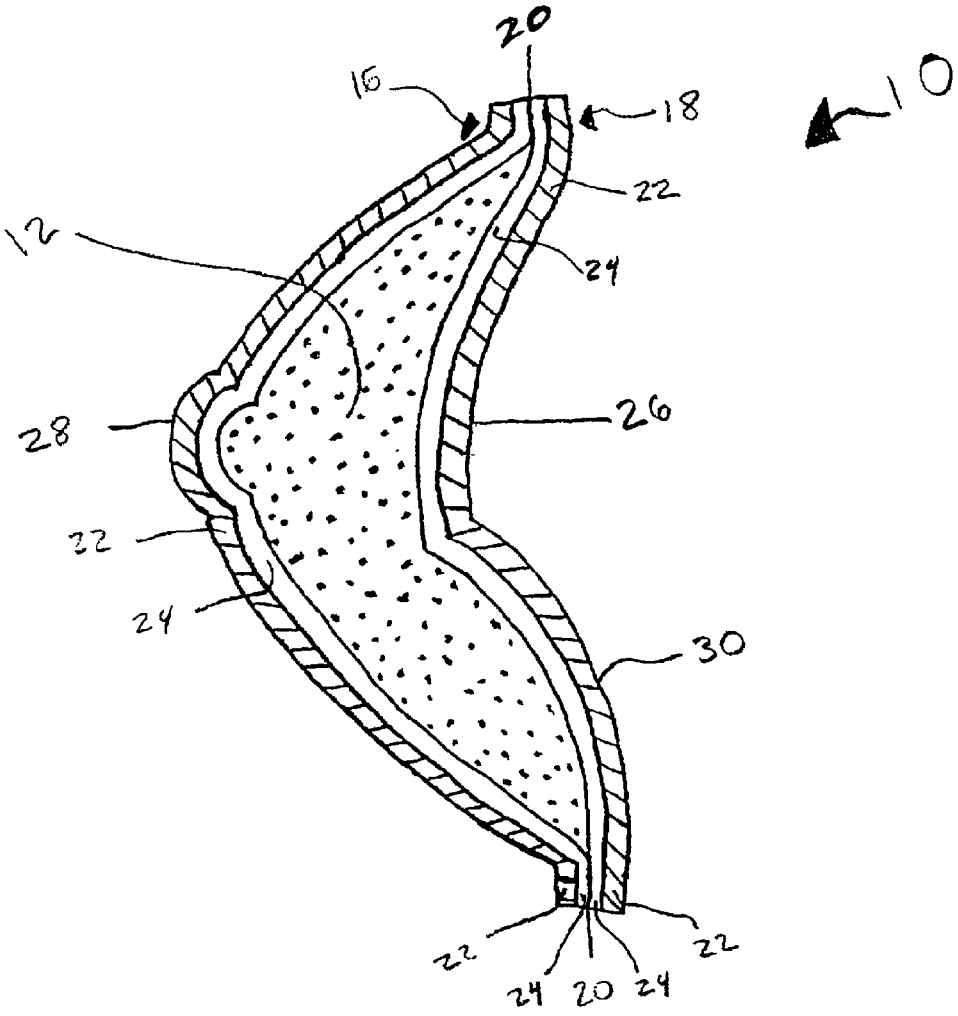
FIG. 2 is a side cross-sectional view of the breast form of FIG. 1.

A side cross-sectional view of the breast form 10 is shown in FIG. 2. The sheet 16 and the sheet 18 each have two layers, namely a fabric layer 22 and a thermoplastic layer 24. The fabric layer 22 and the thermoplastic layer 24 are permanently and inseparably adjoined by heat lamination or other similar processes, and form a single sheet or film. The fabric layer 22 is made of a four-way stretchable material/fabric, meaning that the fabric has a degree of elasticity sufficient to allow for movement in four opposing directions relative to a specified point on the fabric layer. The presently preferred four-way stretchable material is the elastic spandex fabric sold under the trade name LYCRA, specifically LYCRA 8020 offered by Dupont. Other materials having similar four-way stretchable characteristics can also be used.

The thermoplastic layer 22 is made from a material suitable for heat-sealing. Such suitable materials include a range of polymeric materials, the preferred being polyurethane film. The thermoplastic layer shares the four-way stretchable characteristics of the fabric layer, which enables the fabric layer and the thermoplastic layer to move together as a single sheet when the two layers have been permanently adjoined by heat-sealing, which is understood to include heat lamination and other processes used to bond such materials. Thus, the four-way stretchable feature of the fabric layer and the thermoplastic layer allows the breast form to conform to the shape of the user's breast or chest, and not have wrinkles in the surfaces of the breast form.

As shown in FIG. 2, the two sheets 16 and 18 are adjoined along points 20. More specifically, the thermoplastic layers 24 of sheets 16 and 18 are heat-sealed together along points 20, and define the perimeter edge of the breast form. While the sheets 16 and 18 together encase the silicone gel material 12, it is the thermoplastic layers 24 that actually contact the silicone gel material and contain the silicone gel material, thereby defining an inner layer of the flexible chamber. The fabric layers 22 defines an outer layer and an outer surface of the breast form. It is also understood that the relative thicknesses of the fabric layer 22, the thermoplastic layer 24, and the silicone gel material 12 are not shown to scale in FIG. 2, but rather are merely illustrative for purposes of reference of the structure of the breast form 10.

For example, one embodiment of the breast form 10 could include the fabric layer 22 and the thermoplastic layer 24 each having a thickness in the range of 0.5 to 5.0 millimeters, while the silicone gel material 12 could have a diameter in the range of 2 to 12 inches. It is understood, however, that the thicknesses and diameters of each could be varied depending on the desired size of the breast form, the type of fabric used, the type of thermoplastic material used, and the type of silicone gel material used to construct the breast form.

The preferred method of making the present breast form is the patented method disclosed in U.S. Pat. No. 5,693,164, entitled "Method of Making Breast Enhancers." The teachings and disclosures of U.S. Pat. No. 5,693,164 are fully incorporated herein by reference. It is understood that while the patent discloses a method of making breast enhancers that involves two "films of thermoplastic material," the presently disclosed sheets 16 and 18 are equally suitable for practicing the patented method. Instead of using films of thermoplastic material, the sheets 16 and 18, having adjoined fabric layers 22 and thermoplastic layers 24, are used.

It is further understood that the breast form 10 can be made by any other suitable method, and is not limited to manufacture according to the method disclosed in U.S. Patent No. 5,693,164. For example, rather than using the two sheets 16 and 18 to encase the silicone gel material within the breast form, a single sheet of fabric laminated thermoplastic material 14 can be used, wherein the single sheet is folded and positioned around the silicone gel material such that a portion of the thermoplastic layer 24 is positioned over a different portion of the thermoplastic layer 24, thereby allowing the perimeter edges of the overlapping thermoplastic material to be heat-sealed to form a permanent seal that prevents the silicone gel material from escaping the breast form.

With respect to the silicone gel material 12, it is understood that the silicone gel material 12 can comprise a wide range of silicone based compositions suitable for breast forms. As disclosed in U.S. Pat. No. 5,693,164, the silicone gel material inside of the breast form results from curing various compositions and amounts of silicone oils, resins, inhibitors, catalysts and pigments. The structure of the present breast form is intended to be compatible with any type of silicone composition suitable for enhancing or replacing a user's breasts. For example, one type of suitable silicone composition is taken from the family of fully cross-linked organo-polysiloxanes.

For purposes of reducing the weight of the silicone gel material, it is desirable that a light-weight filler be added to the composition. In an example embodiment, a silicone gel composition useful for making a light-weight breast form of this invention may comprise greater than 40 percent by volume light-weight and/or low density filler. A suitable filler can be one having a density of approximately 0.01 $g/cm^3$. If desired, the silicone gel composition can be made approximately 50 percent lighter by weight by replacing 50 percent of the volume of the silicone material, e.g., the organo-polysiloxane, with such a low density filler material. One preferred composition comprises greater than about 40 percent by volume low-density filler, and comprises less than about 60 percent by volume organo-polysiloxane. Although the light weight silicone composition will not likely have a color similar to human skin, it will maintain a natural feel, and the color is irrelevant because the sheets 16 and 18 have the fabric layer covering the silicone composition.

An additional feature of the present breast form 10 is that it can include a permanently grown, re-usable adhesive backing. Referring to FIG. 2, the breast form defines two surfaces relative to the user, an interior surface 26 facing towards the user's breast or skin, and an exterior surface 28 facing opposite the interior surface and away from the user's breast or skin. An adhesive 30 can be permanently positioned along the interior surface 26 of the breast form. In a preferred embodiment, the adhesive 30 is a pressure-sensitive adhesive (PSA) 30 and is permanently grown to the fabric layer 22 of the interior surface 26. The amount of adhesive 30 to be adjoined to the interior surface can vary, as can the portions of the interior surface that have the adhesive. Various factors can contribute to the amount and placement of the adhesive such as the size, shape, and weight of the breast form.

Unlike known adhesives, the adhesive 30 used with this invention will not readily shift once it is positioned on the user and can be re-used repeatedly without losing its adhesive properties. The adhesive 30 has an adhesion force to the fabric layer 22 that is greater than a cohesion force to the user's skin. The adhesive 30 is further able to withstand tremendous movement and pressure from the user without slipping and can even be subjected to water or sweat without degeneration of the adhesive properties. In fact, if the adhesive 30 becomes dirty (i.e. collects unwanted particles such as dust, lint, or debris), it can be cleaned with soap and water to remove the unwanted particles and fully restore the adhesive properties.

In addition to the specific features and embodiments described above, it is understood that the present invention includes all equivalents to the structures described herein, and is not to be limited to the disclosed embodiments. For example, the sizing and configuration of the breast form 10 can be varied depending on the needs of the user. For example, the breast form can be shaped to enhance only a portion of a user's breast, such as a portion removed during a mastectomy, or to enhance or replace an entire breast. Individuals skilled in the art to which the present breast form pertains will understand that variations and modifications to the embodiments described can be used beneficially without departing from the scope of the invention.

What is claimed is:

1. A breast form comprising:

a flexible chamber formed from a thermoplastic film material and a fabric material, wherein the flexible chamber defines the breast form's shape;

a volume of silicone gel composition sealably disposed within the flexible chamber; and the fabric material disposed over and permanently joined to substantially the entire surface of the thermoplastic film material.

2. The breast form as recited in claim 1 wherein the flexible chamber is formed from two sheets of the thermoplastic film material that are sealed together around a perimeter edge of the breast form.

3. The breast form as recited in claim 1 wherein the fabric material is formed from a four-way stretchable fabric.

4. The breast form as recited in claim 1 wherein the silicone gel composition comprises greater than 40 percent by volume low-density filler.

5. A breast form comprising a volume of silicone gel material encased within a flexible chamber formed from a fabric laminated thermoplastic film, wherein the fabric laminated thermoplastic film defines the breast form's shape and comprises a fabric layer and a thermoplastic layer that are inseparably adjoined together, over substantially the entire surface of the breast form, wherein the thermoplastic layer defines an inner layer of the chamber and is in contact with the silicone gel material, and the fabric layer defining an outer layer of the chamber that forms an outer surface of the breast form.

6. The breast form as recited in claim 5 wherein the fabric layer is formed from a four-way stretchable material.

7. The breast form as recited in claim 5 wherein the thermoplastic layer is formed form a polyurethane film.

8. The breast form as recited in claim 5 wherein the flexible chamber is formed from two sheets of the fabric laminated thermoplastic film, wherein the two sheets are heat-sealed together along a perimeter seal of the breast form, and wherein the thermoplastic layers of the two sheets are in direct contact with each other.

9. The breast form as recited in claim 5 wherein the fabric laminated thermoplastic film is folded and positioned to create a desired shape of the breast form, wherein a portion of the thermoplastic layer is positioned over a different portion of the thermoplastic layer, and the perimeter edges of the overlapping thermoplastic layer portions are heat-sealed to form a permanent seal that prevents the silicone gel material from escaping the breast form.

10. The breast form as recited in claim 5 wherein the silicone gel material comprises a composition comprising greater than about 40 percent by volume low-density filler.

11. The breast form as recited in claim 5 wherein the silicone gel material comprises less than about 60 percent by volume organo-polysiloxane.

12. The breast form as recited in claim 5 further comprising a permanently grown pressure-sensitive adhesive adjoined to the fabric layer on an interior surface of the breast form that faces a user's breast or skin.

13. The breast form as recited in claim 12, wherein the permanently grown pressure-sensitive adhesive has an adhesion force to the fabric layer that is greater than a cohesion force to the user's breast or skin.

14. A breast form comprising a volume of silicone gel material encased between two sheets of fabric laminated thermoplastic film, wherein the two sheets define the breast form's shape and are positioned on opposite sides of the volume of silicone gel material and are heat-sealed to one another along a perimeter seal of the breast form, wherein each sheet comprises a fabric layer and a thermoplastic layer that are permanently adjoined together over substantially the entire surface of the breast form, wherein the thermoplastic layer of each sheet is positioned adjacent the volume of silicone gel material and is adjoined to one another along the perimeter seal of the breast form, wherein the fabric layer forms an exposed surface of the breast form, and wherein the fabric layer is formed from a four-way stretchable material.

15. The breast form as recited in claim 14 wherein the thermoplastic layer is a polyurethane film.

16. The breast form as recited in claim 14 further comprising a permanently grown pressure-sensitive adhesive material adjoined to the fabric layer on an interior surface of the breast form that faces a user's breast or skin.

17. The breast form as recited in claim 16, wherein the permanently grown pressure-sensitive adhesive has an adhesion force to the fabric layer that is greater than a cohesion force to the user's breast or skin.

18. A breast form comprising:

a flexible chamber formed from a pair of polyurethane sheets that are sealed together along a perimeter edge of the chamber;

a volume of silicone gel composition sealably disposed within the flexible chamber; and a fabric material that is disposed over and permanently joined to substantially the entire surface of each of the polyurethane sheets and forming exterior surfaces of the breast form, wherein the fabric material is a four-way stretchable fabric.

19. The breast form as recited in claim 18 further comprising a permanently grown pressure-sensitive adhesive material adjoined to the fabric material on an interior surface of the breast form that faces a user's breast.

20. A method for forming a breast form having a fabric covered outer surface, the method comprising the steps of:

forming first and second breast form chamber members by permanently joining together sheets of thermoplastic film material with sheets of fabric material, wherein two such so-joined sheets form the first and second chamber members and define the breast form's shape;

combining the first and second breast form chamber members with one another so that the sheets of thermoplastic film material are positioned opposite one another so as to form a chamber, and the sheets of fabric material form substantially the entire outside surface of the breast form; and inserting a desired volume of silicone gel material into the chamber;

wherein during the step of combining or inserting, the sheets of thermoplastic film are sealed together along a perimeter edge of the chamber.

* * * * *